US008087465B2

(12) United States Patent
Huang et al.

(10) Patent No.: US 8,087,465 B2
(45) Date of Patent: Jan. 3, 2012

(54) LOCKING CAP FOR SUBSEA TREE

(75) Inventors: Alan Huang, Houston, TX (US); Venu Kopparthi, Katy, TX (US); Saul dos Santos Filho, Parana (BR)

(73) Assignee: Aker Subsea Inc., Houston, TX (US)

( * ) Notice: Subject to any disclaimer, the term of this patent is extended or adjusted under 35 U.S.C. 154(b) by 706 days.

(21) Appl. No.: 12/069,942

(22) Filed: Feb. 14, 2008

(65) Prior Publication Data

US 2008/0190621 A1 Aug. 14, 2008

Related U.S. Application Data

(60) Provisional application No. 60/901,524, filed on Feb. 14, 2007.

(51) Int. Cl.
*E21B 23/00* (2006.01)

(52) U.S. Cl. ..... 166/339; 166/341; 166/360; 166/368; 166/75.13

(58) Field of Classification Search ..... 166/343, 166/360, 368, 97.1, 72.13, 339–341
See application file for complete search history.

(56) References Cited

U.S. PATENT DOCUMENTS 3,071,188 A 1/1963 Raulins
3,814,179 A * 6/1974 Hull, Jr. ..... 166/89.2
4,405,016 A 9/1983 Best
5,560,258 A 10/1996 Coffey et al.
5,992,526 A 11/1999 Cunningham et al.
6,152,230 A 11/2000 Edwards et al.
6,227,301 B1 5/2001 Edwards et al.
6,470,968 B1 * 10/2002 Turner ..... 166/348
6,474,416 B2 * 11/2002 Beall et al. ..... 166/343
6,494,257 B2 * 12/2002 Bartlett et al. ..... 166/86.2
6,520,263 B2 2/2003 June
6,554,324 B1 4/2003 Herman
6,612,368 B2 * 9/2003 Kent et al. ..... 166/75.13
6,681,850 B2 * 1/2004 Bartlett et al. ..... 166/86.2
6,719,059 B2 * 4/2004 Dezen et al. ..... 166/368

(Continued)

OTHER PUBLICATIONS

PCT International Preliminary Report on Patentability dated Mar. 4, 2009, for corresponding PCT/US2008/001959, filed Feb. 14, 2008.

(Continued)

*Primary Examiner* — Thomas Beach
*Assistant Examiner* — Matthew Buck
(74) *Attorney, Agent, or Firm* — Parsons Behle & Latimer

(57) ABSTRACT

A locking tree cap for use on a subsea tree. The tree cap may be installed and retrieved using a remote operated vehicle. The tree cap may include deflectable collet fingers that lock the tree cap to a tree spool. The deflectable collet fingers may be adapted, such as with enlarged heads, to extend into recesses of the tree spool when the tree cap has been landed on the tree spool. The tree cap may be locked onto a tree spool before energizing sealing members within the bores of the subsea tree, thereby protecting the sealing members from damage during the installation of the tree cap onto the tree spool. The tree cap may include soft landing means such as a plastic cap, on the end of stabs to protect the sealing members as the tree cap is landed. The tree cap may include a secondary locking mechanism used to further secure the tree cap to the tree spool.

23 Claims, 15 Drawing Sheets

U.S. PATENT DOCUMENTS

| | | | | |
|---|---|---|---|---|
| 6,763,891 | B2 * | 7/2004 | Humphrey et al. | 166/368 |
| 6,810,954 | B2 | 11/2004 | Garrett et al. | |
| 6,845,815 | B2 * | 1/2005 | Hergarden et al. | 166/92.1 |
| 7,156,169 | B2 * | 1/2007 | Bartlett | 166/66.7 |
| 7,325,598 | B2 * | 2/2008 | Bartlett | 166/75.13 |
| 7,490,673 | B2 * | 2/2009 | Bartlett | 166/368 |
| 7,621,338 | B2 * | 11/2009 | Wenham et al. | 166/343 |
| 7,637,325 | B2 * | 12/2009 | Goonetilleke et al. | 166/368 |
| 7,677,319 | B2 * | 3/2010 | Baskett | 166/360 |
| 2002/0088622 | A1 * | 7/2002 | Beall et al. | 166/342 |
| 2002/0185279 | A1 * | 12/2002 | Blair et al. | 166/335 |

OTHER PUBLICATIONS

PCT International Search Report and Written Opinion for PCT/US2008/001959, dated Jun. 19, 2008.

Examination Report under Section 18(3) for corresponding Application No. GB0915142.4 issued on Jan. 18, 2011.

* cited by examiner

LOCKING CAP FOR SUBSEA TREE

CROSS REFERENCE TO RELATED APPLICATION

This application is a non-provisional utility application claiming priority to U.S. Provisional patent application No. 60/901,524, entitled, "Locking Cap for Subsea Tree," by Saul dos Santo Filho, Alan Huang, and Venu Kopparthi, filed Feb. 14, 2007, incorporated by reference herein its entirety.

FIELD OF THE INVENTION

The present invention generally relates to subsea oil and gas production apparatus and methods and, more particularly, a locking tree cap for a single or multiple bore subsea tree.

BACKGROUND OF THE INVENTION

A wellhead assembly, such as that employed on the seabed for offshore drilling and production operations, may often include a tree spool used to access the well bore. The tree spool may be a dual bore spool providing access to both a production bore and an annulus bore. A tree cap may be used to both seal off the bores as well as allow access to the tree spool. One or more seals are typically disposed between the tree cap and the tree spool.

The installation and retrieval of a tree cap on a subsea tree spool can be difficult due to subsea depths and the potential heavy weight of the tree cap. It would thus be beneficial to provide a light weight tree cap to facilitate the installation and retrieval of the tree cap by a remote operated vehicle (ROV). The tree cap may have integral buoyancy to regulate wet weight. The tree cap may have integral buoyancy to help the underwater transport of the tree cap. For example, a buoyant material such as foam may be attached to reduce the underwater weight of the tree cap.

One problem that may be encountered when installing a tree cap with an ROV is properly aligning the tree cap with the tree spool. It thus may be beneficial for a tree cap and tree spool that are configured such that the tree cap is properly aligned on the tree spool. For example, the tree spool may include a means for properly aligning the tree cap on the tree spool, such as a funnel structure and/or a pin that engages a recess on the tree cap.

Another problem that may be encountered when installing a tree cap is properly securing the tree cap onto the tree spool. It would be beneficial to provide deflectable collet fingers that are adapted to snap into a recess when the tree cap has been landed. The deflectable collet fingers may secure the tree cap to the tree spool while a hydraulic plate, cylinder, or piston moves stabs into the bores. The hydraulic plate, cylinder, or piston may be used to overcome the outward force of the deflectable collet fingers. It may also be desirable to provide a secondary locking mechanism that secures the tree cap to the tree spool.

Fluid may become trapped within the cavity of the tree cap while the tree cap is installed onto a tree spool. This may be problematic as the fluid may cause corrosion, encourage microbial or algae growth, or otherwise prevent the tree cap from properly landing on the tree spool. It would be beneficial to provide means, such as a port, for releasing trapped fluid from within the cavity of the tree cap. It would also be beneficial if this means allowed for injection of fluid, such as corrosion inhibitor, biotoxin, or hydrate formation inhibitor, within the tree cap. Further, it would be desirable if this means also allows the production bore and/or annulus bore to be flushed prior to removal of the tree cap from the tree spool. It would further be desirable to provide another means, such as a port and valve in the tree spool, for flushing the production bore and/or annulus bore prior to removal of the tree cap from the tree spool. It would also be desirable to provide a tree cap that provides for hydraulic isolation between the production bore and the annulus bore of a dual bore subsea tree.

Another problem that may be encountered when installing a tree cap is preventing damage to the seals within the tree cap. It is important that the seals within the tree cap are protected as the tree cap is installed onto the tree spool. Energizing the seals after the tree cap has been locked onto the spool may be one way to ensure the seals are not damaged during the installation of the tree cap onto the tree spool. A hydraulic plate, cylinder, or piston may be used to engage production and annulus stabs into their respective bores to energize seals within the bores. It would also be beneficial to provide means to pressure test the seals after the tree cap has been landed. Providing a tree cap that includes a port, or combination of ports, through which the ROV can pressure test the seals may be one way to test the seals after the tree cap has been landed. It may further be desirable to provide a tree cap with a plastic cap on the ends of a production stab and an annulus stab to protect the tree cap and the tree spool while the tree cap is landed on the tree spool.

The present invention is directed to overcoming, or at least reducing the effects of, one or more of the issues set forth above.

SUMMARY OF THE INVENTION

The object of the present disclosure is to provide a locking tree cap that may be installed onto a tree spool using an arm of a ROV. In one embodiment, the tree cap includes at least one deflectable collet finger that locks the tree cap to the tree spool. The at least one deflectable collet finger may be adapted to extend into a recess of the tree spool when the tree cap has been landed onto the tree spool. The tree cap also includes a stab that is moveable between a first stab position and a second stab position within a bore of the tree spool. The movement of the stab to the second stab position may prevent the at least one deflectable collet finger from backing out of the recess of the tree spool. The stab includes at least one sealing member that is energized, in the second stab position, by the engagement of the sealing member with a seal area within the bore of the tree spool after the at least one deflectable collet finger locks the tree cap to the tree spool. The tree cap may also include a secondary locking mechanism to secure the tree cap to the tree spool.

In one embodiment, the tree cap includes a tree cap for a dual bore subsea tree. The tree cap includes deflectable collet fingers adapted to extend into recesses in production and annulus bores of the subsea tree when the tree cap is landed. In one version, the tree cap includes a stationary piston, piston plate slidably moveable about the stationary piston, a stab plate, a production stab, and an annulus stab. At a point in time after the tree cap has landed, hydraulic pressure is applied to the piston plate causing the piston plate to stroke down, which in turn moves the stab plate to engage the production stab into the production bore and the annulus stab into the annulus bore. In another version, the tree cap includes a moveable piston, piston plate, a stab plate, a production stab, and an annulus stab. The piston is movable between a first piston position and a second piston position. Hydraulic pressure is applied to the piston causing the piston to stroke down. The piston then engages the stab plate, which in turn engages the production stab into the production bore and the annulus stab into the annulus bore. In both versions, the engagement of the stabs into their respective bores prevents the deflectable collet fingers from backing out of the recesses in the bores of the subsea tree. Shoulders of the stabs may be positioned to help prevent the deflectable collet fingers from backing out of the recesses in the bores of the subsea tree. The engagement of the stabs may energize sealing members on the stabs by the engagement of the sealing members into seal areas within the bores of the subsea tree. When the stabs retract, such as when the piston plate and stab plate stroke up in one version or when the piston strokes up in another version, the sealing members of the stabs may disengage the seal areas within the bores of the subsea tree and the deflectable collet fingers may release from the recesses in the bores of the subsea tree. The tree cap may include a soft landing means, which may be made of plastic, located on the end of the production stab and on the end of the annulus stab for protection of the sealing members during landing. The tree cap may also include a secondary locking mechanism to secure the tree cap to the subsea tree.

There is also disclosed a method for installing a locking tree cap onto a tree spool with a ROV. The method includes landing the tree cap onto a tree spool wherein at least one deflectable collet finger is adapted to extend into a recess of the tree spool. The method includes engaging at least one stab within a bore of the tree spool and moving the at least one stab from a first stab position to a second stab position. The method further includes forming a seal between the at least one stab and the bore with the at least one sealing member on the at least one stab in the second stab position. The method may further include engaging a secondary locking mechanism to secure the tree cap to the tree spool. The method may further include positioning a shoulder of a stab adjacent the at least one deflectable collet finger to prevent the at least one deflectable collet finger from releasing from the recess of the tree spool.

The method may further include moving a hydraulic plate, cylinder, or piston from a first position to a second position to engage the at least one stab into the second stab position. The method may also include returning the hydraulic plate, cylinder, or piston to the first position allowing the deflectable collet finger to release from the recess of the tree spool. The method may further include removing an emergency release device to allow the tree cap to be removed from tree spool.

There is also disclosed a tree cap with a secondary locking mechanism that includes a stationary piston, a retaining cap coupled to the stationary piston, a piston plate slidably moveable about the stationary piston, and a stab connected to the piston plate and moveable within a bore of a subsea tree between a first stab position and a second stab position. The secondary locking mechanism has a locked opening and an unlocked opening, the locked opening having a smaller open area than the unlocked opening. The secondary locking mechanism may be moved between an unlocked position and a locked position. In the locked position, the locked opening of the secondary locking mechanism engages the retaining cap and the piston plate locking the stab in the second stab position.

In another embodiment, the tree cap includes a secondary locking mechanism, a piston moveable in a piston housing, a retaining cap coupled to the piston housing, and a stab connected to the piston and moveable within a bore of a subsea tree between a first stab position and a second stab position. The secondary locking mechanism has a locked opening and an unlocked opening, the locked opening having a smaller open area than the unlocked opening. The secondary locking mechanism may be moved between an unlocked position and a locked position. In the locked position, the locked opening of the secondary locking mechanism engages the retaining cap and the piston locking the stab in the second stab position. The piston may include a protrusion positioned within a chamber of the piston housing that engages the locked opening of the secondary locking mechanism in the locked position locking the stab in the second stab position.

There is also disclosed a method for installing a locking tree cap onto a tree spool with a secondary locking mechanism. The method includes landing the tree cap onto the tree spool. The method includes providing a secondary locking mechanism having a locked opening and an unlocked opening, the locked opening having a smaller open area than the unlocked opening. The method further includes moving the secondary locking mechanism from an unlocked position to a locked position, whereby in the locked position the locked opening engages a piston and prevents the removal of the tree cap from the tree spool.

The foregoing and other features of the invention will become further apparent the following description and upon reference to the following drawings.

Figure 1:
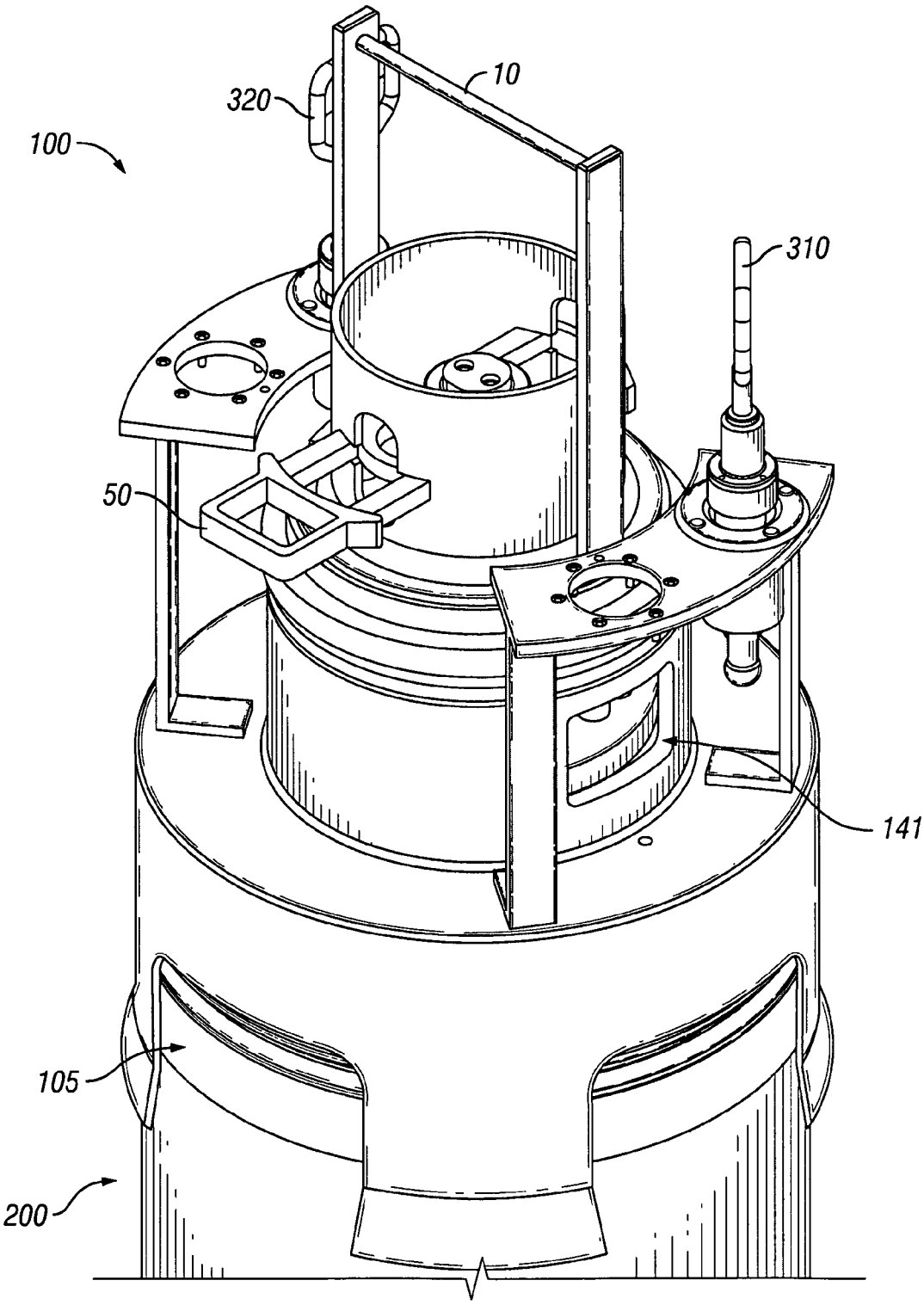
FIG. 1 shows an isometric view of one embodiment of a tree cap landed on a tree spool.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the tree cap that may be installed and removed on a tree spool by a ROV. In the interest of clarity, all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 shows one embodiment of a tree cap 100 installed onto a tree spool 200. The tree cap 100 includes windows 105, which may allow for the visual alignment of the tree cap 100 onto the tree spool 200. The tree cap 100 includes a secondary locking mechanism 50. The secondary locking mechanism 50 may be moved between an unlocked position and a locked position. In the locked position, the secondary locking mechanism 50 prevents the removal of the tree cap 100 from the tree spool 200. The tree cap 100 includes a first hot stab 310 and a second hot stab 320. One of the hot stabs may be connected to provide hydraulic fluid to a piston 20 (see FIG. 2) and the other hot stab may be connected to a port 60 (see FIG. 2) and valve (not shown) that allows for the injection of fluid, such as corrosion inhibitor, biotoxin, or hydrate formation inhibitor, into the tree cap 100. The tree cap 100 includes a structure, such as a handle 10, that allows an arm of a ROV to manipulate the tree cap 100. The ROV may be able to use the handle 10 to remove the tree cap 100 from the tree spool 200 in the event the hydraulics within the tree cap 100 have failed to operate properly.

Figure 2:
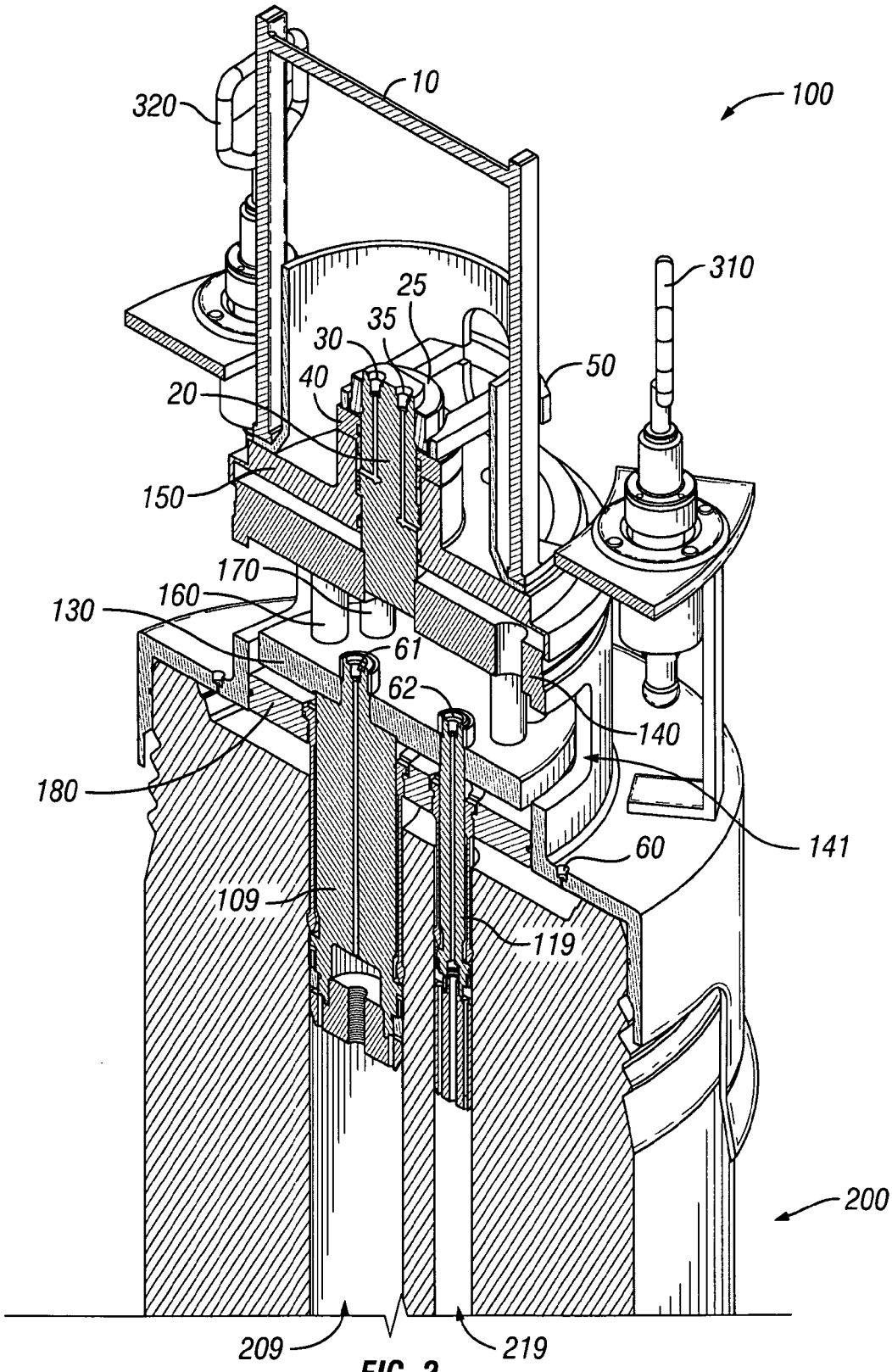
FIG. 2 shows a cross-sectional view of the tree cap of FIG. 1 landed on the tree spool.

FIG. 2 shows a cross-section view of the tree cap 100 of FIG. 1 installed onto the tree spool 200. The tree cap 100 includes the piston 20 that is fixed to a tree cap housing 140. A piston plate 150 is positioned to slidably move about the piston 20. The piston plate 150 is connected to a stab plate 130 by a first plurality of members 170. The first plurality of members 170 extends through the tree cap housing 140. The tree cap 100 also includes a second plurality of members 160 that connects the tree cap housing 140 to a fixed plate 180. The piston 20 includes two ports 30, 35 through which hydraulic pressure may be applied. The application of hydraulic pressure through ports 30, 35 causes the piston plate 150 to move downward, which also moves the stab plate 130 downward due to the connection of the piston plate 150 and the stab plate 130 by the first plurality of members 170.

The downward movement of the stab plate 130 engages a production stab 109 and an annulus stab 119, each having an upper end and a lower end, into their respective bores 209, 219 of the tree spool 200. The production stab 109 and the annulus stab 119 are connected to the stab plate 130. When the stab plate 130 is positioned in its lower position against the fixed plate 180, the tree cap 100 is locked onto the tree spool 200. The tree spool 100 includes a port 60 which may allow the release of fluid trapped within the cavity of the tree cap 100. The port 60 may also allow the injection of fluid, such as corrosion inhibitor, biotoxin, or hydrate formation inhibitor, into the tree cap 100 and tree spool 200. The port 60 may include a valve (not shown) to control fluid flow through the port 60. The tree cap 100 includes a retaining cap 25 coupled to the piston 20 and a secondary locking mechanism 50. The secondary locking mechanism 50 may engage the retaining cap 25 to lock the piston plate 150 and the stab plate 130 in their lower positions. The tree cap 100 of FIG. 2 is shown for illustrative purposes for use with a dual bore tree spool having a production bore 209 and an annulus bore 219. The tree cap 100 of the present invention may be used with single or multiple bore tree spools as would be appreciated by one of ordinary skill in the art having the benefit of this disclosure.

Figure 3:
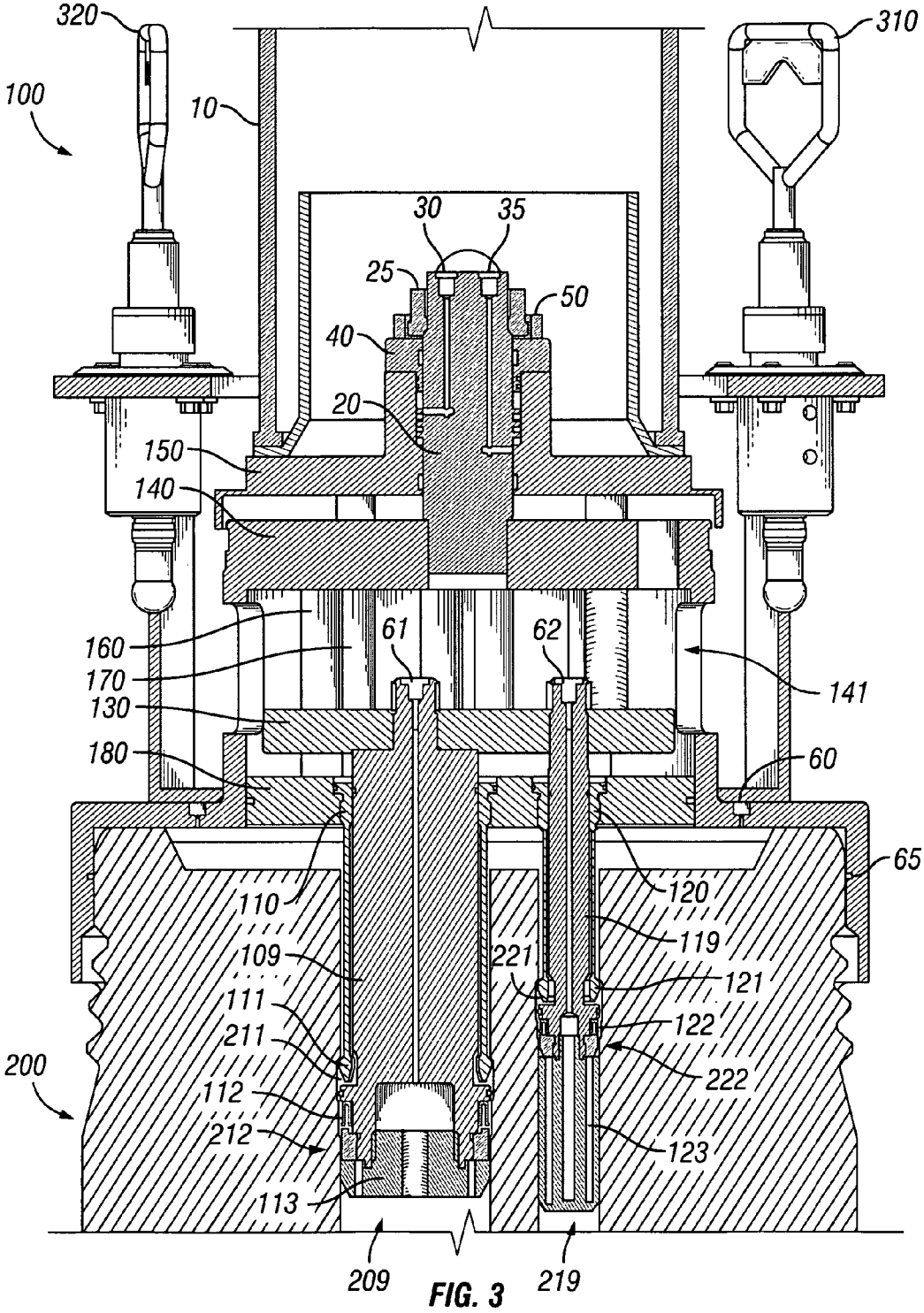
FIG. 3 shows a cross-section view of the tree cap of FIG. 1 showing the deflectable collet fingers, sealing members, seal areas, stabs, and plastic caps of the stabs.

FIG. 3 shows a cross-section view of the tree cap 100 of FIG. 1. The tree cap 100 includes a first plurality of deflectable collet fingers 110 connected to the fixed plate 180. The deflectable collet fingers 110 enter the production bore 209 of the tree spool 200 as the tree cap 100 is installed onto the tree spool 200. The deflectable collet fingers 110 are adapted with enlarged heads 111 that snap into a recess 211 of the tree spool 200 when the tree cap 100 is landed onto the tree spool 200. The production stab 109 includes at least one sealing member 112. The sealing member 112 may be made of metal, non-ferrite metal, or an elastomer, or any combination thereof. When the at least one sealing member 112 of the production stab 109 engages a seal area 212 of the production bore 209, the at least one sealing member 112 forms a seal between the production stab 109 and the production bore 209. The production stab 109 includes soft landing means 113, such as a plastic end cap located on the lower end of the production stab 109, that helps to prevent damage to the sealing member 112 as the tree cap 100 is landed on the tree spool 200.

The tree cap 100 also includes a second plurality of deflectable collet fingers 120 connected to the fixed plate 180. The second plurality of deflectable collet fingers 120 enters the annulus bore 219 of the tree spool 200 as the tree cap 100 is installed onto the tree spool 200. The deflectable collet fingers 120 are adapted with enlarged heads 121 that snap into a recess 221 of the tree spool 200 when the tree cap 100 is landed onto the tree spool 200. The annulus stab 119 includes at least one sealing member 122. The sealing member 122 may be made of metal, non-ferrite metal, or an elastomer, or any combination thereof. When the sealing member 122 of the annulus stab 119 engages a seal area 222 of the annulus bore 219, the at least one sealing member 122 forms a seal between the annulus stab 119 and the annulus bore 219. The annulus stab 119 includes soft landing means 123, such as a plastic end cap located on the lower end of the annulus stab 119, that helps to prevent damage to the sealing member 122 as the tree cap 100 is landed on the tree spool 200.

The tree cap 100 includes a port 60 that may be used to release fluid trapped within the cavity of the tree cap 100. The port 60 may include a spring loaded valve (not shown) used to control fluid flow through the port as would be appreciated by one of ordinary skill in the art having the benefit of this disclosure. The port 60 may also be used to inject fluid, such as corrosion inhibitor, biotoxin, or hydrate formation inhibitor, into the tree cap 100. The tree cap 100 also includes ports 61 and 62 that may be used to release fluid from the production bore 209 and annulus bore 219 respectively. Ports 61 and 62 may also be connected to a one of the hot stabs 310 or 320 through, for example, a window 141 in the tree cap housing 140 to pressure test the seals formed between the stabs 109, 119 and their respective bores 209, 219. The tree cap 100 includes at least one seal 65 to prevent fluid, such as corrosion inhibitor, biotoxin, or hydrate formation inhibitor, from exiting the tree cap 100 while the tree cap 100 is landed on the tree spool 200. The tree cap 100 may include a various number of seals in various locations to prevent fluid leakage as would be appreciated by one of ordinary skill in the art having the benefit of this disclosure. The tree cap 100 also includes a retaining cap 25 and a piston plate end cap 40. The secondary locking mechanism 50 may be engaged to lock both the piston plate 150 and the stab plate 130 in their lower positions.

Figure 4:
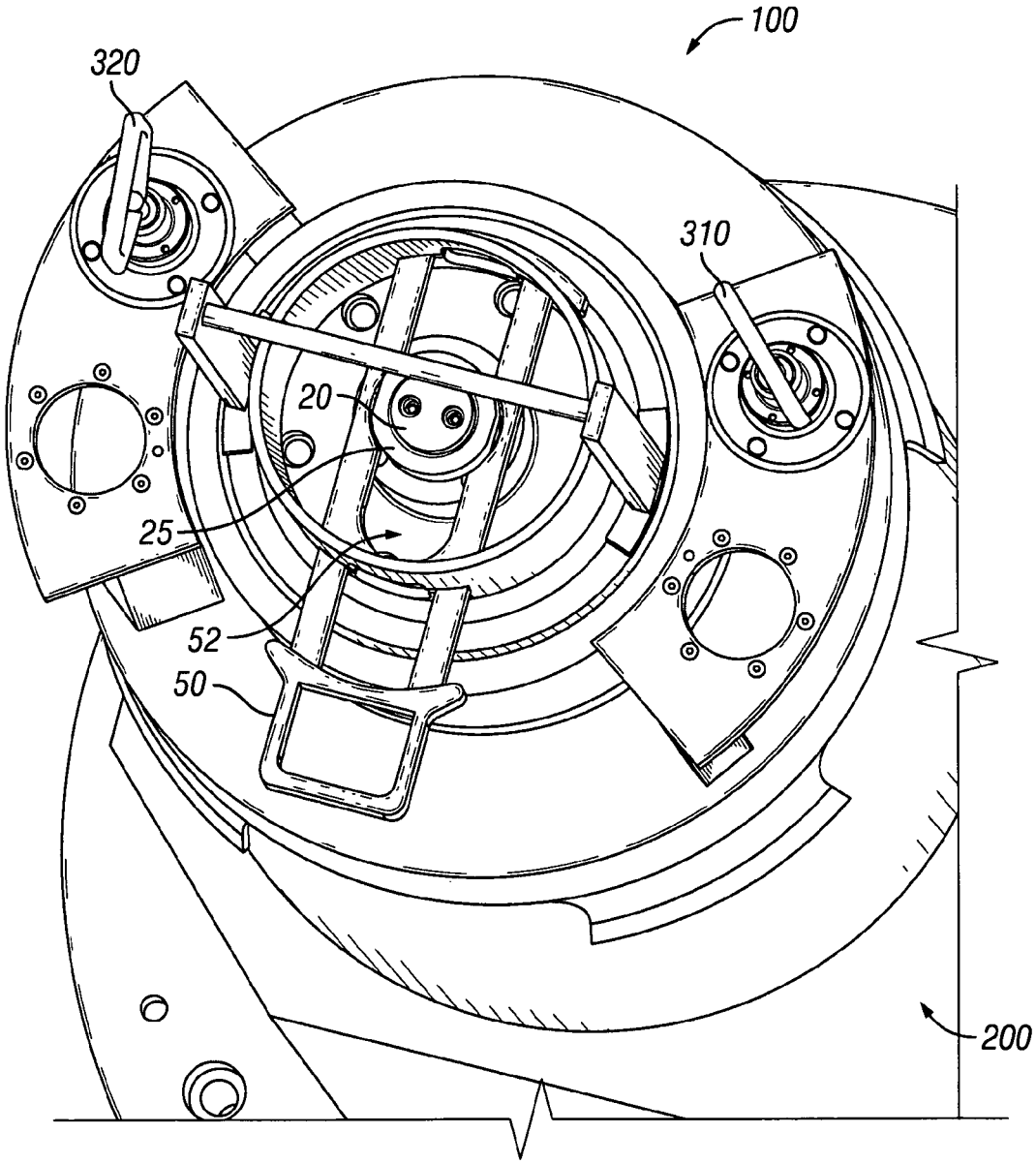
FIG. 4 shows the top view of tree cap of FIG. 1 with the secondary locking mechanism in the unlocked position.
Figure 5:
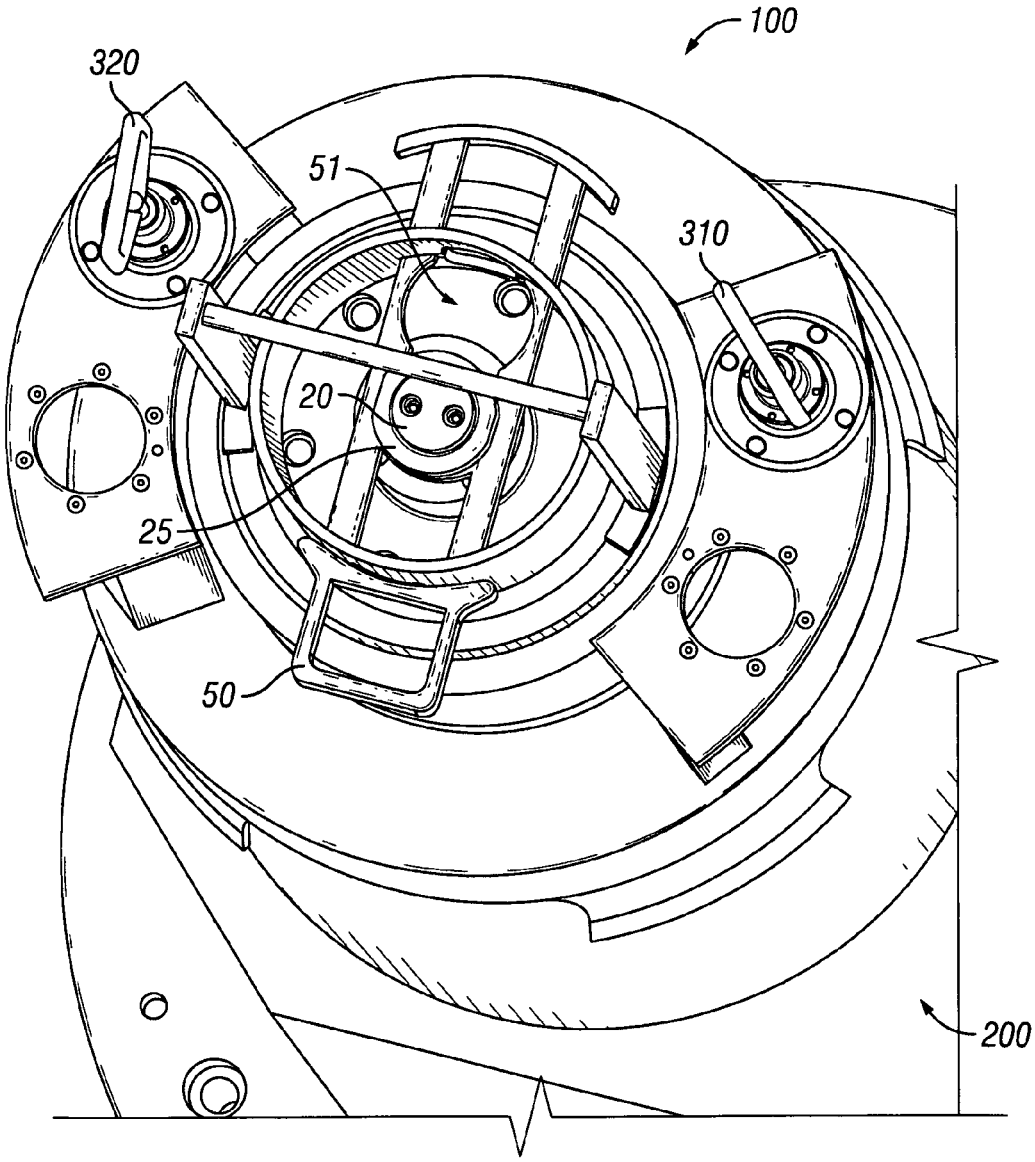
FIG. 5 shows the top view of tree cap of FIG. 1 with the secondary locking mechanism in the locked position.

FIGS. 4 and 5 show a top view of the secondary locking mechanism 50 that may be used with the tree cap 100 of FIG. 1. The secondary locking mechanism 50 includes an unlocked opening 51 and a locked opening 52. The unlocked opening 51, which is larger than the locked opening 52, permits the upward movement of the piston plate 150 and the stab plate 130. FIG. 4 shows the secondary locking mechanism 50 in the unlocked position while FIG. 5 shows the secondary locking mechanism 50 in the locked position. The secondary locking mechanism 50 may be moved between the unlocked and locked position by using the arm of an ROV to simply slide the secondary locking mechanism 50 between positions. The secondary locking mechanism 50 may engage the retaining cap 25 to lock the piston plate 150 and the stab plate 130 in their second or lower position, which, in turn, causes the seal members 112, 122 to engage the seal areas of the production bore 209 and annulus bore 219. In this position, the stabs 109, 119 prevent the enlarged heads 111, 121 of the deflectable collet fingers 110, 120 from backing out of the recesses 211, 221 in the bores 209, 219 within the tree spool 200.

Figure 6:
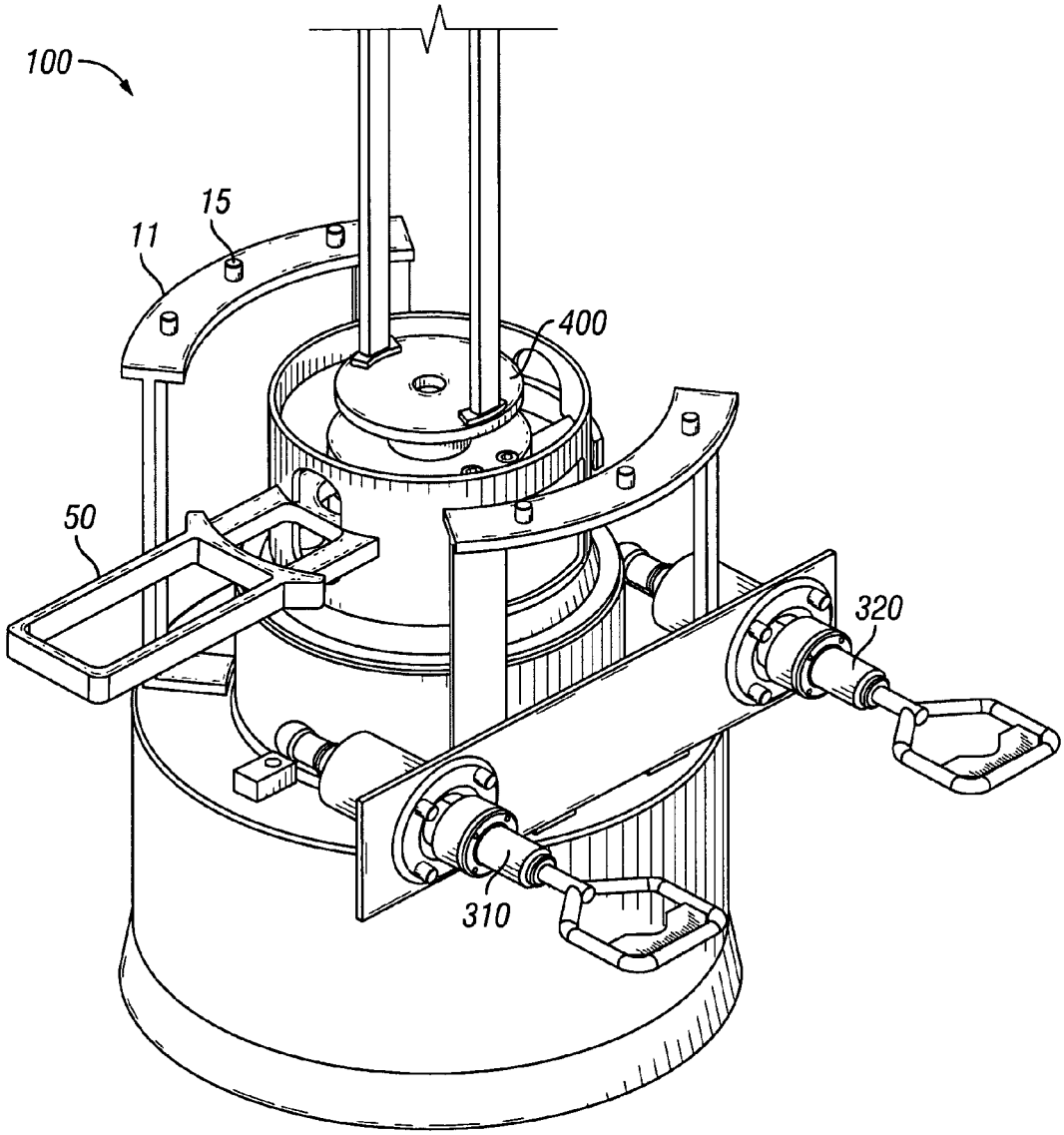
FIG. 6 shows an isometric view of one embodiment of a tree cap landed on a tree spool.

FIG. 6 is another embodiment of a tree cap 100 designed to further reduce the weight of the tree cap 100. FIG. 6 shows an isometric view of the tree cap 100 installed on a tree spool 200. The tree cap 100 includes rails 11 and bolts 15 that may be used to fasten buoyancy material to the tree cap 100. For example, the bolts 15 may be used to attach buoyant material such as foam to the tree cap 100. The buoyant material may cause the tree cap 100 to regulate the wet weight and help the underwater transport of the tree cap. The two hot stabs 310, 320 may be connected to inject hydraulic fluid to operate a piston 20 (see FIG. 7), inject fluid, such as corrosion inhibitor, biotoxin, or hydrate formation inhibitor, into the tree cap 100, and pressure test seals formed between the tree cap 100 and the tree spool 200. The tree cap 100 includes an emergency release device 400 that allows for the removal of the tree cap 100 in the event that hydraulic control of the piston 20 is lost. The emergency release device 400 may also be used to handle the tree cap 100 while transporting the tree cap 100 to or from the tree spool 200.

Figure 7:
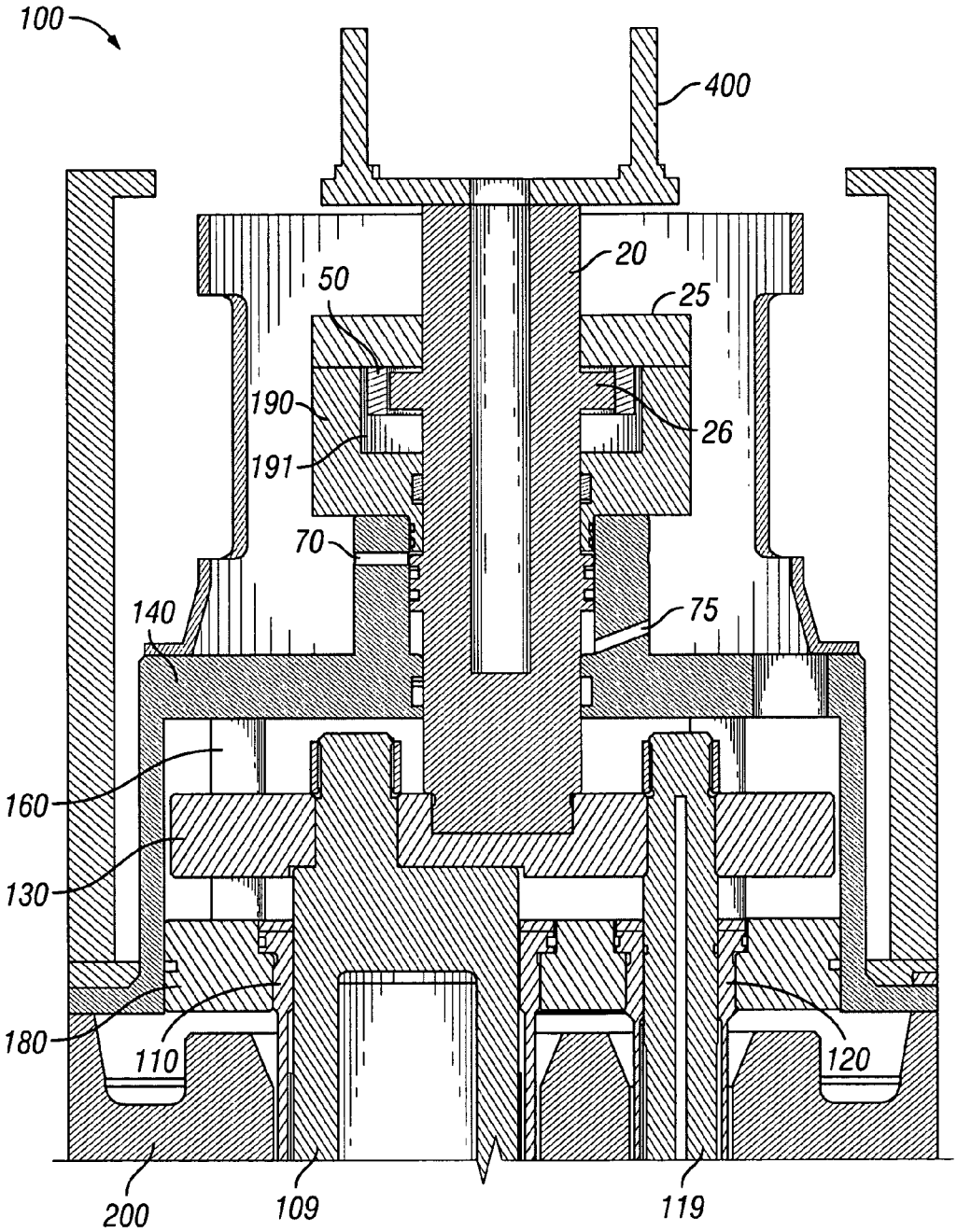
FIG. 7 shows a cross-sectional view of the tree cap of FIG. 6 landed on the tree spool.

FIG. 7 is a cross-sectional view of the tree cap 100 of FIG. 6 installed onto the tree spool 200. Hydraulic fluid may be pumped through ports 70, 75 to move the piston 20 between a first position and a second position. FIG. 7 shows the piston in the upper, first or unlocked position. An emergency release device 400 is connected to the piston 20 and provides for the removal of the tree cap 100 in the event of an emergency.

The piston 20 extends through a tree cap housing 140 to connect to a stab plate 130. The tree cap housing 140 is connected to a fixed plate 180 by a plurality of members 160. The tree cap housing 140 includes two ports 70, 75 through which hydraulic pressure may be applied. The application of hydraulic pressure through the ports 70, 75 moves the piston 20 between an upper, first position and a lower, second position, which also moves the stab plate 130. FIG. 7 shows the piston 20 and the stab plate 130 in their upper, first position.

Figure 10:
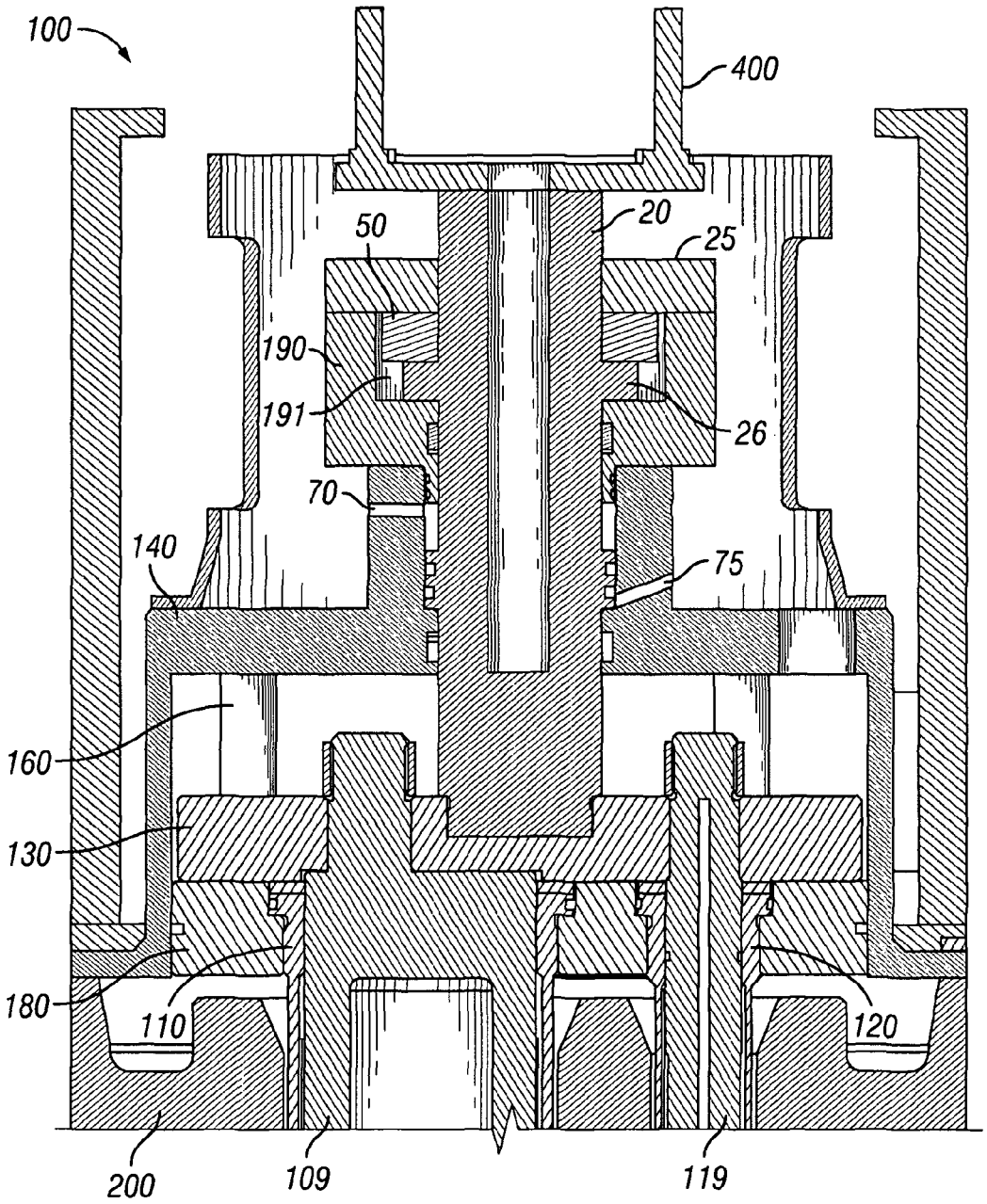
FIG. 10 shows a cross-sectional view of the tree cap of FIG. 6 with the piston in the locked position.

The piston 20 includes a protrusion 26 positioned in a chamber 191 within a piston housing 190 and a retaining cap 25. The tree cap 100 includes a secondary locking mechanism 50, which may engage the retaining cap 25 and the protrusion 26 within the chamber 191 of the piston housing 190 preventing the upward movement of the piston 20 and locking the piston 20 in the lower, second position as shown in FIG. 10. The tree cap 100 of FIG. 6 is shown for illustrative purposes for use with a dual bore tree spool having a production bore 209 and an annulus bore 219. The tree cap of the present invention may be used with single or multiple bore tree spools as would be appreciated by one of ordinary skill in the art having the benefit of this disclosure.

Figure 8:
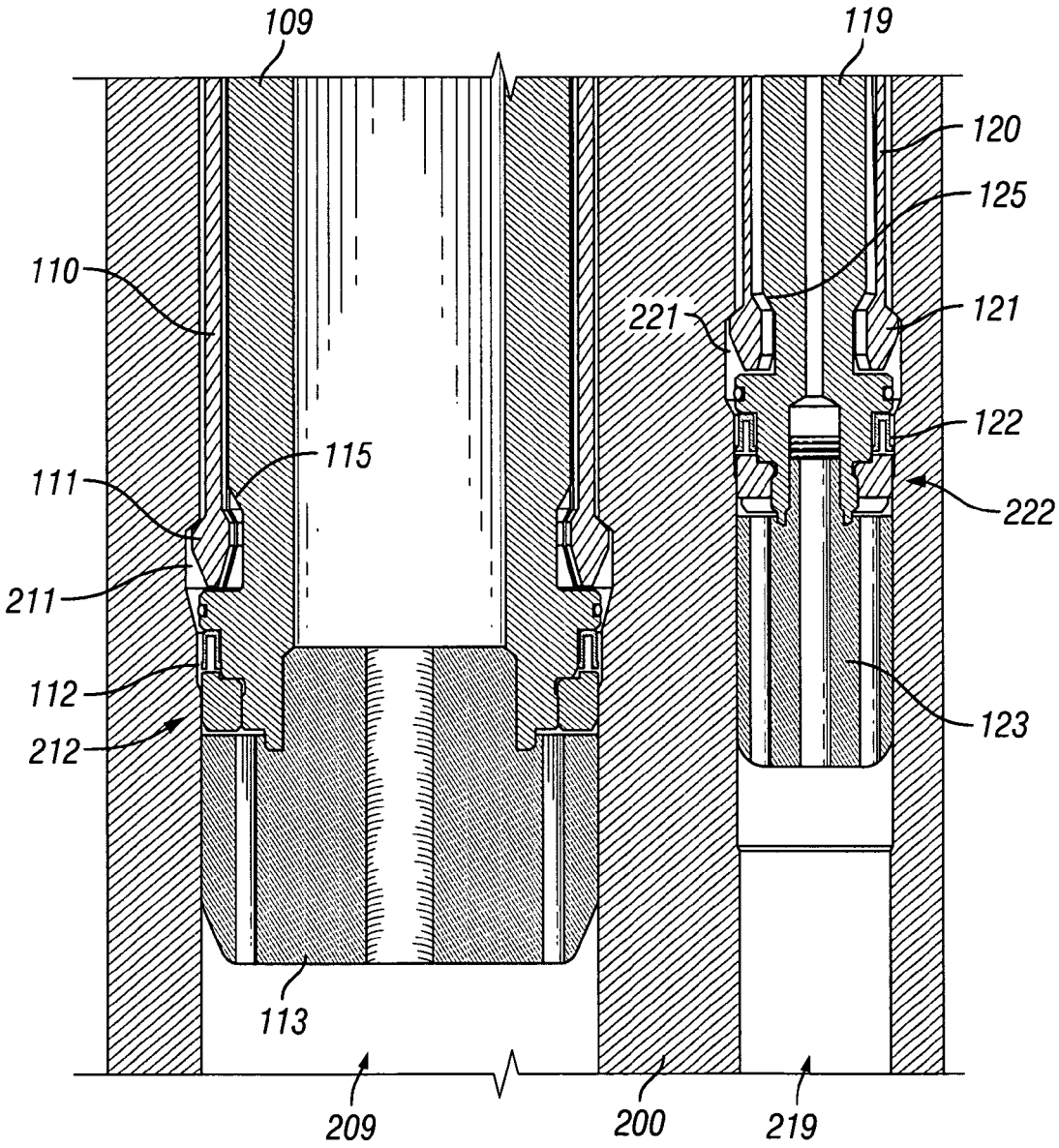
FIG. 8 shows a cross-section view of the tree cap of FIG. 6 showing the deflectable collet fingers, sealing members, seal areas, stabs, and plastic caps of the stabs.

FIG. 8 shows a cross-sectional view of stabs 109, 119 of the tree cap 100 of FIG. 6 in the upper, first or unlocked position. The tree cap 100 has been landed on the tree spool 200 and the enlarged heads 111, 112 of deflectable collet fingers 110, 120 have snapped into recesses 211, 221 within the production bore 209 and annulus bore 219 respectively. The deflectable collet fingers 110, 120 hold the tree cap 100 on the tree spool 200 while piston 20 is moved downwards causing the sealing members 112, 122 of the production stab 109 and the annulus stab 119 to engage seal areas 212, 222 of the production bore 209 and annulus bore 219 respectively. The piston 20 (as shown in FIG. 7) is in its upper, first position. While in the upper, first position, the sealing member 112 of the production stab 109 is located above the seal area 212 of the production bore 209. The diameter of the seal area 212 is smaller than the diameter of the production bore 209 above the seal area 212, which helps to protect the sealing member 112 as the tree cap 100 is landed. This also ensures that the sealing member 112 is not energized until the piston 20 causes the production stab 109 to move downwards and engage the seal area 212 of the production bore 209. The smaller diameter of the seal area 212 ensures that a seal is created between the production stab 109 and the production bore 209. In the unlocked position, a shoulder 115 of the production stab 109 is located above the enlarged head 111 of the deflectable collet finger 110. The production stab 109 includes soft landing means 113, such as a plastic end cap located on the lower end of the production stab 109, that helps to prevent damage to the sealing member 112 as the tree cap 100 is landed on the tree spool 200.

The sealing member 122 of the annulus stab 119, like the sealing member 112 of the production stab 109, is located above the seal area 222 of the annulus bore 219. The diameter of the seal area 222 is smaller than the diameter of the annulus bore 219 above the seal area 222. This helps to protect the sealing member 122 as the tree cap 100 is landed onto the tree spool 200. This also ensures that the sealing member 122 is not energized until the piston 20 causes the annulus stab 119 to move downwards and engage the seal area 222 of the annulus bore 219. The smaller diameter of the seal area 222 ensures that a seal is created between the annulus stab 119 and the annulus bore 219. In the unlocked position, a shoulder 125 of the annulus stab 119 is located above the enlarged head 121 of the deflectable collet finger 120. The annulus stab 119 includes soft landing means 123, such as a plastic end cap located on the lower end of the annulus stab 119, that helps to prevent damage to the sealing member 122 as the tree cap 100 is landed on the tree spool 200.

Figure 9:
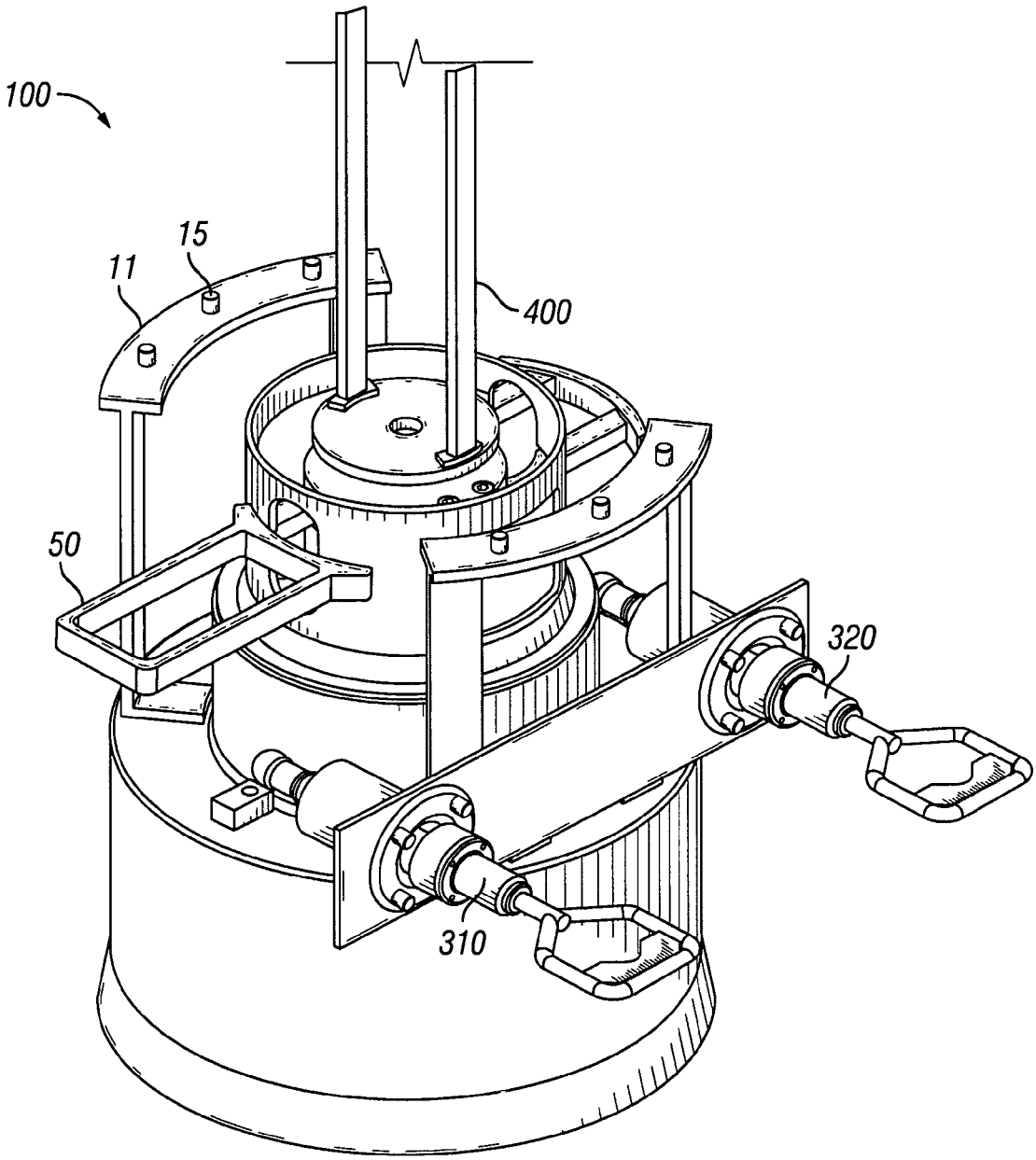
FIG. 9 shows an isometric view of the tree cap of FIG. 6 with the secondary lock mechanism locking the tree cap on the tree spool.
Figure 11:
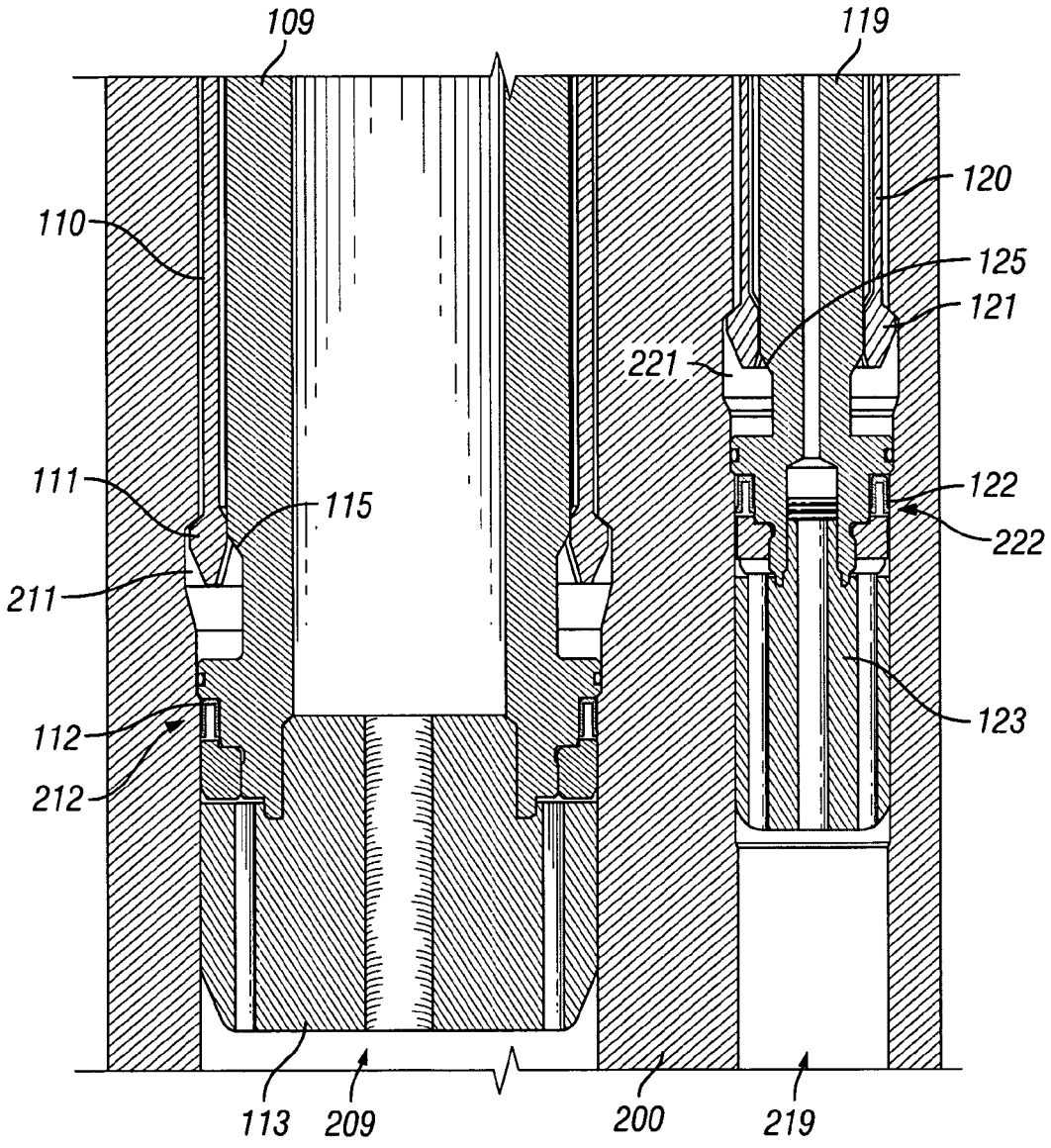
FIG. 11 shows a cross-sectional view of the tree cap of FIG. 6 with the stabs in the locked position preventing the deflectable collet fingers from releasing the tree cap.

FIGS. 9-11 show the tree cap 100 of FIG. 6 in the lower, second or locked position on the tree spool 200. FIG. 9 shows the secondary locking mechanism 50 that has been moved to a second position that locks the tree cap 100 onto the tree spool 200. The secondary locking mechanism 50 engages the retaining cap 25 and the protrusion 26 of the piston 20 within the piston housing 190 preventing the upward movement of the piston 20 and locking the piston 20 in the lower, second position as shown in FIG. 10. Hydraulic fluid has been injected through ports 70, 75 to move the piston 20 downwards to its lower, second position.

The downward movement of the piston 20 moves the stab plate 130 towards the fixed plate 180. The production stab 109 and the annulus stab 119 are connected to the stab plate 130. The downward movement of the stab plate 130 causes the production stab 109 and the annulus stab 119 to move further into their respective bores 209, 219 of the tree spool 200 until the sealing members 112, 122 engage the seal areas 212, 222 as shown in FIG. 11. When the stab plate 130 is positioned in its lower, second position against the fixed plate 180, the tree cap 100 is locked onto the tree spool 200. The tree cap 100 may include a port similar to port 60 shown in FIGS. 2 and 3, which allows the release of fluid trapped within the cavity of the tree cap 100. The port may also allow the injection of fluid, such as corrosion inhibitor, biotoxin, or hydrate formation inhibitor, into the tree cap 100 and tree spool 200. The port may include a valve (not shown) to control fluid flow through the port. The tree cap 100 may also include ports similar to ports 61 and 62 shown in FIGS. 2 and 3 that may be used to release fluid from the production bore 209 and annulus bore 219 respectively. Ports similar to ports 61 and 62 shown in FIGS. 2 and 3 may also be connected to one of the hot stabs 310 or 320 through, for example, a window similar to window 141 shown in FIGS. 1-3 in the tree cap housing 140 to pressure test the seals formed between the stabs 109, 119 and their respective bores 209, 219.

FIG. 11 shows a cross-sectional view of the stabs 109, 119 with the sealing members 112, 122 properly positioned within the seal areas 212, 222. The respective diameters of the seal areas 212, 222 are properly sized to energize the sealing members 112, 122 creating a seal between the stabs 109, 119 and the corresponding bores 209, 219 of the tree spool 200. In this position, the shoulder 115 of the production stab 109 has moved adjacent to or past the enlarged head 111 of the deflectable collet finger 110. The larger width of the production stab 109 above the shoulder 115 retains the enlarged head 111 of the deflectable collet finger 110 within the recess 211 in the production bore 209. The tree cap 100 is now locked on the tree spool 200 as the enlarged head 111 of the deflectable collet finger 110 may not be backed out of the recess 211 until the piston 20 has been moved back to the first position, which, in turn, retracts the production stab 109 within the production bore 209 removing the sealing members 112 from the seal area 212.

The shoulder 125 of the annulus stab 119 has also been moved adjacent to or past the enlarged head 121 of the deflectable collet finger 120. The larger width of the annulus stab 119 above the shoulder 125 prevents the enlarged head 121 of the deflectable collet finger 120 from backing out of the recess 221 in the annulus bore 219. The tree cap 100 is now locked on the tree spool 200 as the enlarged head 121 of the deflectable collet finger 120 may not be backed out of the recess 221 until the piston 20 has been moved back to the first position, which, in turn, retracts the annulus stab 119 within the annulus bore 219 removing the sealing members 122 from the seal area 222. The tree cap 100 provides that the sealing members 112, 122 may be energized at a point after the tree cap 100 has been landed on the tree spool 200.

Figure 12:
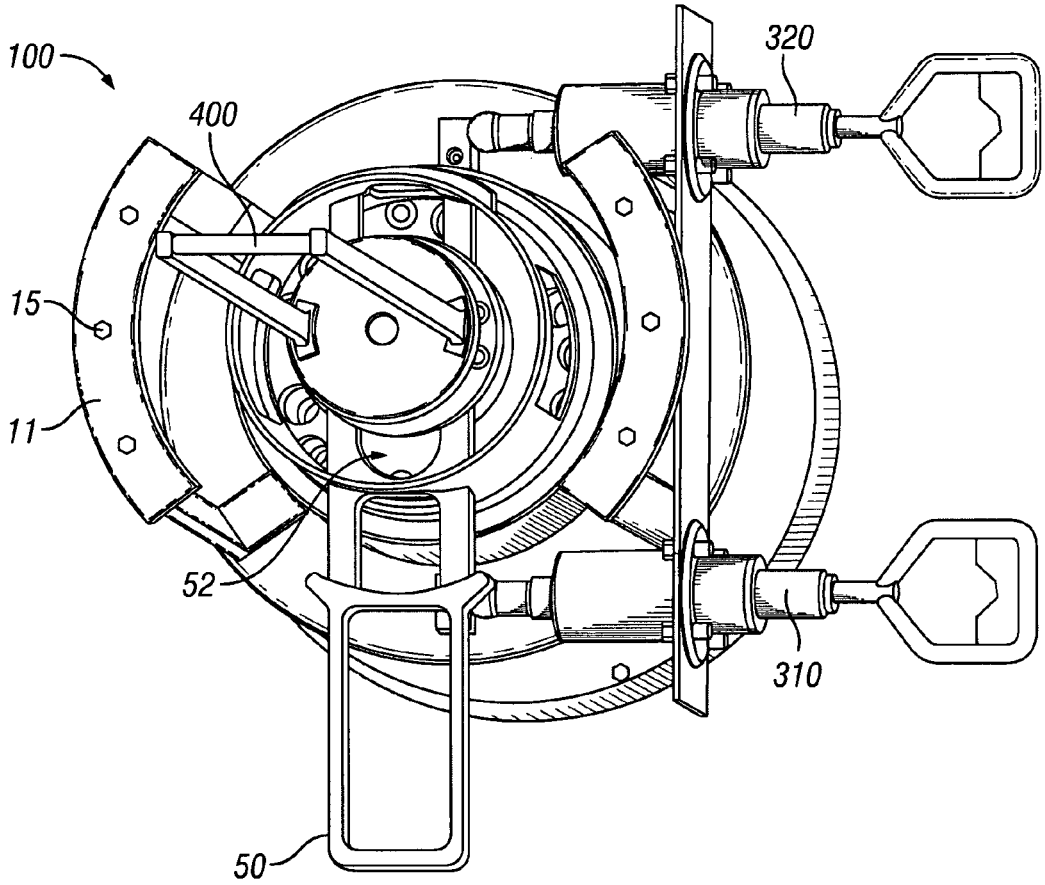
FIG. 12 shows a top view of the tree cap of FIG. 6 with the secondary locking mechanism in the unlocked position.
Figure 13:
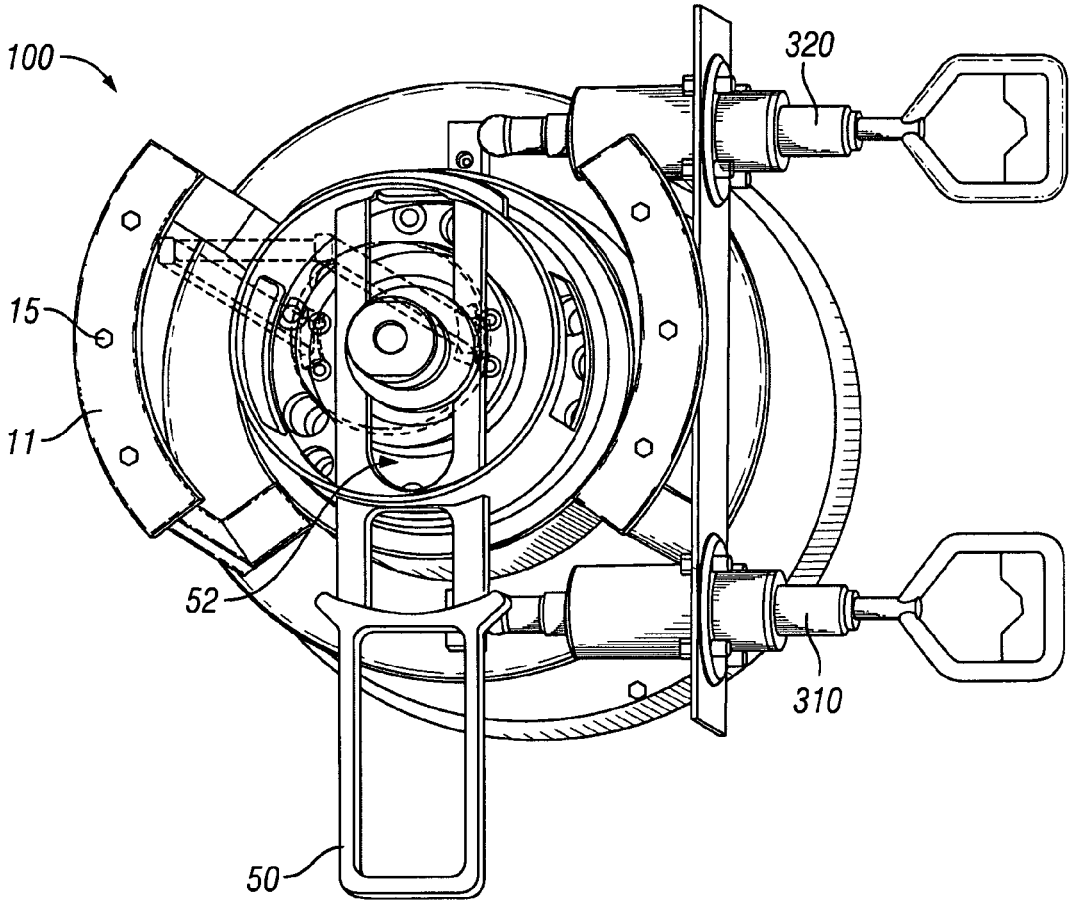
FIG. 13 shows a top view of the tree cap of FIG. 6 with the secondary locking mechanism in the unlocked position and the emergency release device shown as transparent to better illustrate the secondary locking mechanism.
Figure 14:
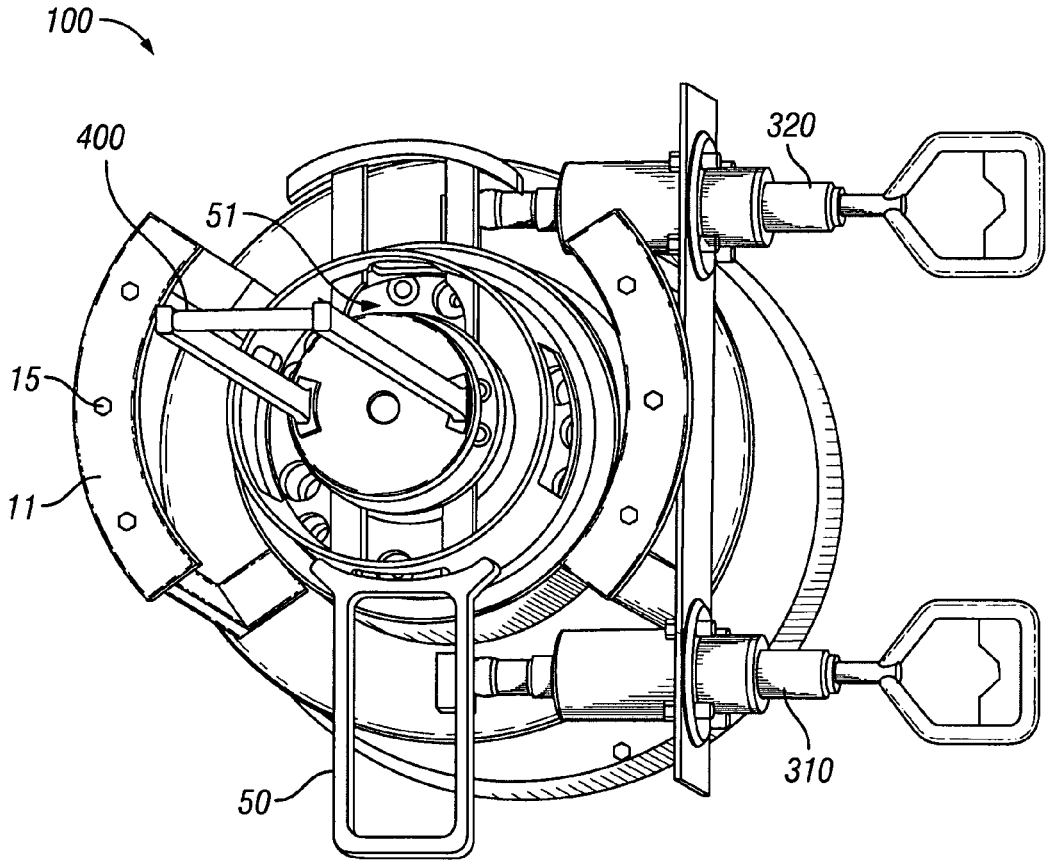
FIG. 14 shows a top view of the tree cap of FIG. 6 with the secondary locking mechanism in the locked position.
Figure 15:
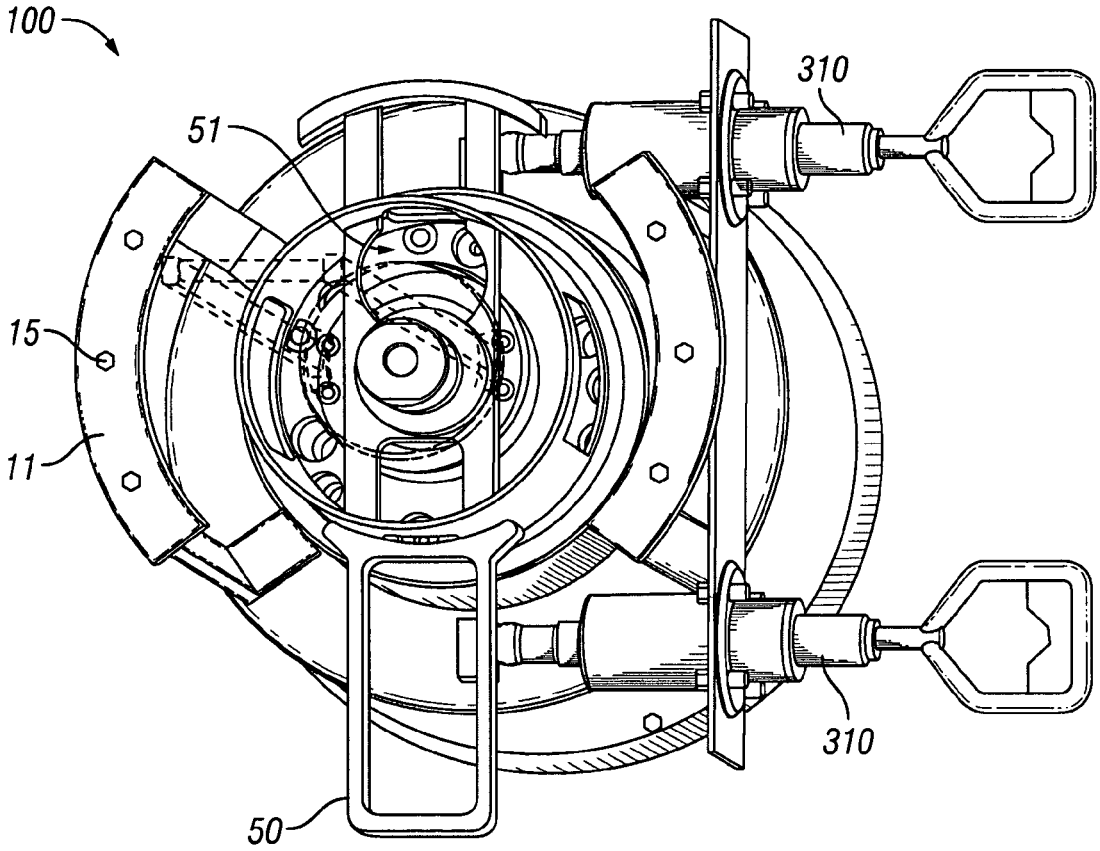
FIG. 15 shows a top view of the tree cap of FIG. 6 with the secondary locking mechanism in the locked position and the emergency release device shown as transparent to better illustrate the secondary locking mechanism.

FIGS. 12-15 show a top view of one embodiment of the secondary locking mechanism 50 that may be used with the tree cap 100 of FIG. 6. The secondary locking mechanism 50 includes an unlocked opening 51 and a locked opening 52. The unlocked opening 51, which is larger than the locked opening 52, permits the upward movement of the piston 20. FIGS. 12-13 show the secondary locking mechanism 50 in the unlocked position while FIGS. 14-15 show the secondary locking mechanism 50 in the locked position. FIGS. 13 and 15 show the emergency release device 400 as transparent to better illustrate the operation of the secondary locking mechanism 50.

The secondary locking mechanism 50 may be moved between the unlocked and locked position by using the arm of an ROV to simply slide the secondary locking mechanism 50 between positions. Referring to FIGS. 9-11, 14-15, the secondary locking mechanism 50 may engage the retaining cap 25 to lock the piston 20 in its lower, second position, which, in turn, engages the sealing members 112, 122 and prevents the enlarged heads 111, 121 of the deflectable collet fingers 110, 120 from backing out of the recesses 211, 221 in the bores 209, 219 within the tree spool 200.

Although various embodiments have been shown and described, the invention is not so limited and will be understood to include all such modifications and variations as would be apparent to one skilled in the art.

What is claimed is:

1. A tree cap for a subsea tree, the tree cap comprising:

a deflectable collet finger, wherein the deflectable collet finger engages a recess in the subsea tree when the tree cap is landed;

a stab movable within a bore in the subsea tree between a first stab position and a second stab position after the tree cap has landed on the subsea tree; and a sealing member on the stab for sealing between the stab and the bore;

whereby the stab in the second stab position resists the removal of the deflectable collet finger from the recess and whereby the sealing member on the stab forms a seal between the stab and the bore.

2. The tree cap of claim 1 wherein a shoulder of the stab in the second stab position is positioned to prevent the deflectable collet finger from releasing from the recess in the subsea tree.

3. The tree cap of claim 1 further comprising a moveable piston that engages and moves the stab between the first stab position and the second stab position.

4. The tree cap of claim 1 further comprising means for releasing fluid trapped within the tree cap.

5. The tree cap of claim 1 further comprising means for allowing injection of fluid into the tree cap.

6. The tree cap of claim 1 further comprising a soft landing means located on the stab to protect the sealing member on the stab during landing.

7. The tree cap of claim 1 wherein the tree cap is installed and retrieved using a remote operated vehicle.

8. The tree cap of claim 1 further comprising an emergency release device that allows the tree cap to be removed from the subsea tree.

9. The tree cap of claim 1 wherein the subsea tree includes a plurality of bores.

10. A tree cap for a subsea tree, the tree cap comprising:

a deflectable collet finger, wherein the deflectable collet finger engages a recess in the subsea tree when the tree cap is landed;

a stab movable within a bore in the subsea tree between a first stab position and a second stab position after the tree cap has landed on the subsea tree;

a sealing member on the stab for sealing between the stab and the bore; and a stationary piston, a piston plate, and a stab plate, wherein the piston plate slidably moves about the stationary piston and wherein the piston plate and the stab plate are connected so as to engage and move the stab between the first stab position and the second stab position, whereby the stab in the second stab position resists the removal of the deflectable collet finger from the recess and whereby the sealing member on the stab forms a seal between the stab and the bore.

11. A tree cap for a subsea tree, the tree cap comprising:

a locking mechanism having a locked opening and an unlocked opening, the locked opening having a smaller open area than the unlocked opening;

a stationary piston;

a retaining cap coupled to the stationary piston;

a piston plate slidably moveable about the stationary piston; and a stab connected to the piston plate and movable within a bore in the subsea tree between a first stab position and a second stab position;

whereby in a locked position the locked opening engages the retaining cap and the piston plate locking the stab in the second stab position.

12. The tree cap of claim 11 further comprising a deflectable collet finger that engages a recess in the subsea tree when the stab is in the first stab position.

13. The tree cap of claim 12 wherein the locked opening in the locked position prevents the deflectable collet finger from backing out of the recess in the subsea tree.

14. A tree cap for a subsea tree, the tree cap comprising:

a locking mechanism having a locked opening and an unlocked opening;

a piston, the piston being moveable within a piston housing;

a retaining cap coupled to the piston housing; and a stab connected to the piston and movable within a bore in the subsea tree between a first stab position and a second stab position;

whereby in a locked position the locked opening engages the retaining cap and the piston locking the stab in the second stab position.

15. The tree cap of claim 14 wherein the piston has a protrusion positioned within a chamber of the piston housing that engages the locked opening in the locked position locking the stab in the second position.

16. The tree cap of claim 14 further comprising a deflectable collet finger that engages a recess in the subsea tree when the stab is in the first stab position.

17. The tree cap of claim 16 wherein the locking mechanism in the locked position prevents the deflectable collet finger from backing out of the recess in the subsea tree.

18. The tree cap of claim 14 wherein the stab in the second stab position forms a seal between the stab and the bore.

19. A method for installing a tree cap onto a tree spool of a subsea tree, the method comprising:

landing the tree cap onto the tree spool so that a deflectable collet finger of the tree cap is positioned within a recess in the tree spool;

engaging a stab within a bore in the tree spool, the stab having a sealing member;

moving the stab from a first stab position to a second stab position; and forming a seal between the stab and the bore with the sealing member in the second stab position, wherein in the second stab position, a shoulder of the stab is positioned to prevent the deflectable collet finger from releasing from the recess in the tree spool.

20. The method of claim 19 further comprising engaging a locking mechanism to prevent the deflectable collet finger from backing out of the recess in the tree spool.

21. The method of claim 19 further comprising moving a piston from a first piston position to a second piston position, whereby the piston engages and moves the stab from the first stab position to the second stab position.

22. The method of claim 19 further comprising providing an emergency release device to allow the tree cap to be removed from the tree spool.

23. The method of claim 19 wherein a remote operated vehicle is used to land the tree cap onto the tree spool.

* * * * *